US005346412A

United States Patent [19]

Fedder et al.

[11] Patent Number: 5,346,412

[45] Date of Patent: Sep. 13, 1994

[54] BREAK AWAY KEY AND LATCH ASSEMBLY

[75] Inventors: James L. Fedder, Etters; John R. Shuey, Mechanicsburg, both of Pa.

[73] Assignee: The Whitaker Corporation, Wilmington, Del.

[21] Appl. No.: 98,486

[22] Filed: Jul. 27, 1993

[51] Int. Cl.[5] ..... H01R 13/64

[52] U.S. Cl. ..... 439/681; 439/701

[58] Field of Search ..... 439/571, 677, 680, 681, 439/701

[56] References Cited

U.S. PATENT DOCUMENTS

| | | | |
|---|---|---|---|
| 3,112,974 | 12/1963 | Curtis et al. | 439/681 X |
| 4,350,409 | 9/1982 | Kato et al. | 439/681 |
| 4,415,214 | 11/1993 | Obst | 439/681 X |
| 4,448,471 | 5/1984 | Berry et al. | 439/680 X |
| 4,506,949 | 3/1985 | Knop | 350/162.19 |
| 4,579,412 | 4/1986 | Czeschka et al. | 439/680 X |
| 4,773,881 | 9/1988 | Adams, III | 439/681 |
| 4,900,274 | 2/1990 | Dorleans et al. | 439/680 |
| 4,984,992 | 1/1991 | Beamenderfer et al. | 439/108 |
| 5,178,561 | 1/1993 | Lindeberg et al. | 439/681 X |
| 5,190,476 | 3/1993 | Chaillot | 439/680 X |

*Primary Examiner*—Khiem Nguyen

[57] ABSTRACT

An electrical connector comprises, an insulative housing block (2), electrical contacts (4) held by the housing block (2), spring fingers (11) on each of the contacts (4) for gripping onto a conductive pin, cavities (6) in an insulating housing (5) for receiving the fingers (11), mouths (19) opening into the cavities (6) for receiving conductive pins to be gripped by the spring fingers (11), and a break way key and latch assembly (30) for connecting together the housing block (2) and the housing (5).

11 Claims, 4 Drawing Sheets

BREAK AWAY KEY AND LATCH ASSEMBLY

FIELD OF THE INVENTION

The invention relates to a removable key for electrical connectors, and, more particularly, to a break away key and latch assembly for an electrical connector.

BACKGROUND OF THE INVENTION

An electrical connector known from U.S. Pat. No. 4,984,992, comprises, an insulative housing block, electrical contacts held by the housing block, spring fingers on each of the contacts for gripping onto a conductive pin, and cavities in an insulating housing for receiving the fingers. The pin extends into a mouth of the cavity, the spring fingers are inserted into the cavity and grip onto the conductive pin.

According to an electrical connector assembly, as disclosed in U.S. Pat. No. 4,506,949, electrical cable connectors are connected to respective groups of electrical wires. The connectors are adapted for mating connection with a header. The connectors are adapted with electrical contacts connected to the wires to connect the wires to an array of conductive pins projecting through a bottom of the header.

According to U.S. Pat. No. 4,984,992, a cable connector comprises, respective groups of electrical wires terminated with electrical contacts in multiple housing blocks. The housing blocks are nested together in a housing.

Removable keys on a connector are disclosed in U.S. Pat. No. 4,773,881. The keys are joined to the connector by weakened areas. Each of the weakened areas can be broken to remove a selected key from the connector.

SUMMARY OF THE INVENTION

A feature of the invention resides in a removable key for a connector, the key being unitary with a latch, and the key being removable from the latch.

Another feature of the invention resides in a key unitary with a latch for retaining together separate parts of an electrical connector, the key being removable from the latch.

Another feature of the invention resides in a key having removable keying elements joined with a latch for retaining together an insulating housing and an insulating housing block of an electrical connector.

According to the invention, an electrical connector comprises, at least one external key on the connector being received by the keying elements to align the connector for connection with selected pins, the key being removable for replacement by another key, and a combination of removable fingers of the key comprising; at least one finger removed and at least one other remaining finger on the key, the remaining finger being received by the keying elements.

DESCRIPTION OF THE DRAWINGS

An embodiment of the invention will now be described by way of example, with reference to the accompanying drawings, according to which.

DETAILED DESCRIPTION

Figure 1:
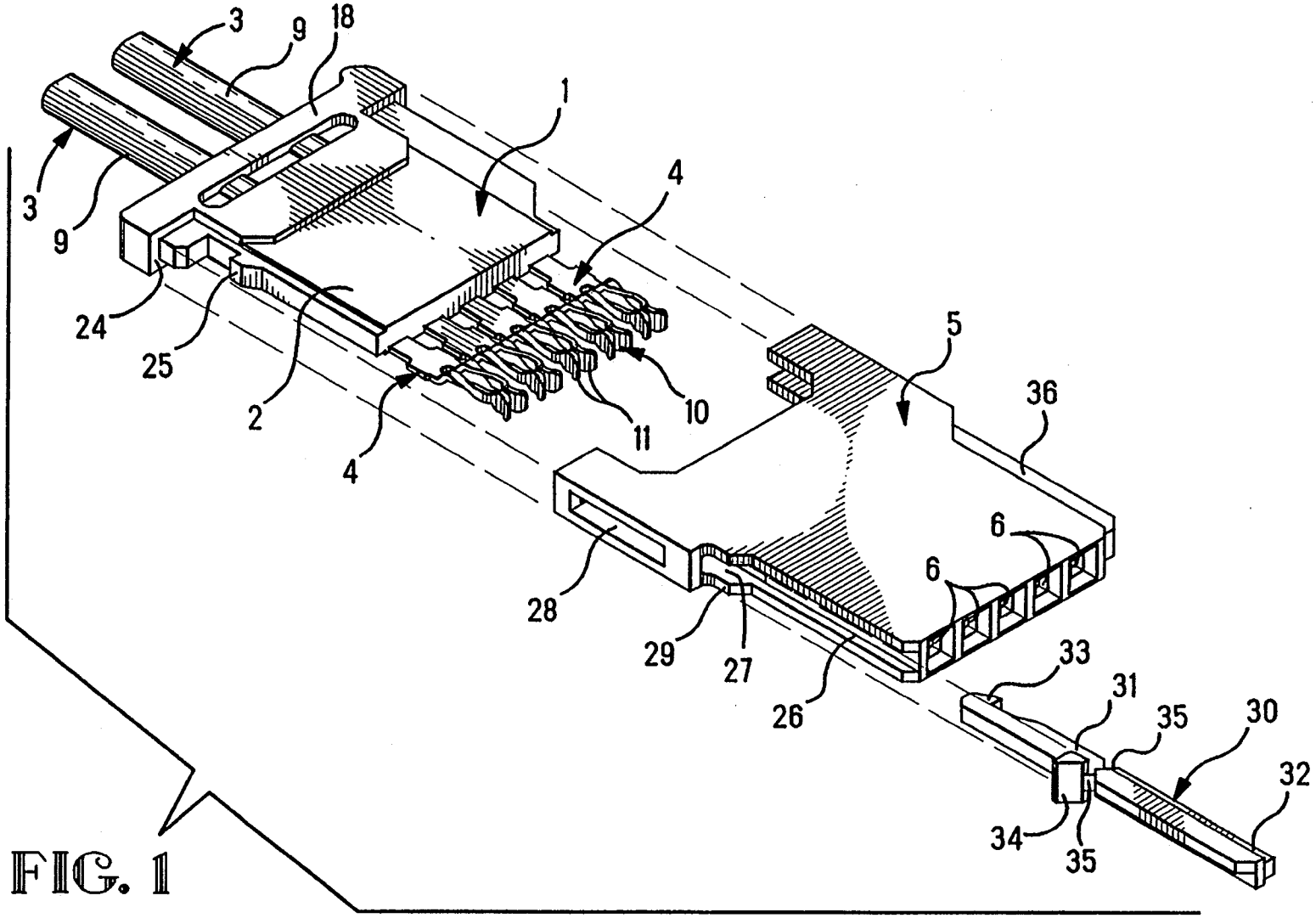
FIG. 1 is an isometric view of a cable connector with parts separated from one another.

With reference to FIG. 1, a cable connector 1 comprises, a housing block 2, at least one electrical cable 3, although two are disclosed, connected to conductive electrical contacts 4 in a row, and an insulating housing 5 containing contact receiving cavities 6. A representative cable 3, FIG. 2, has at least one signal wire 7, although two are shown, and at least one ground, or reference, wire 8 for connection to a reference electrical potential, not shown. Each signal wire 7 is insulated. Each reference wire 8 is beside an insulated signal wire 7, and may be in contact with electrical shielding, not shown, encircling the insulated signal wire 7 and the ground wire 8. An insulative jacket 9 of a corresponding cable 3 covers the shielding. The central one of five of the multiple contacts 4 is a ground contact, and is connected to the reference wire 8 of each of the cables 3. The remaining contacts 4 in the row are signal contacts connected to respective signal wires 7. Connection of the contacts 4 to the respective, signal wires 7 and the reference wires 8 is accomplished by welding or soldering, for example.

Figure 2:
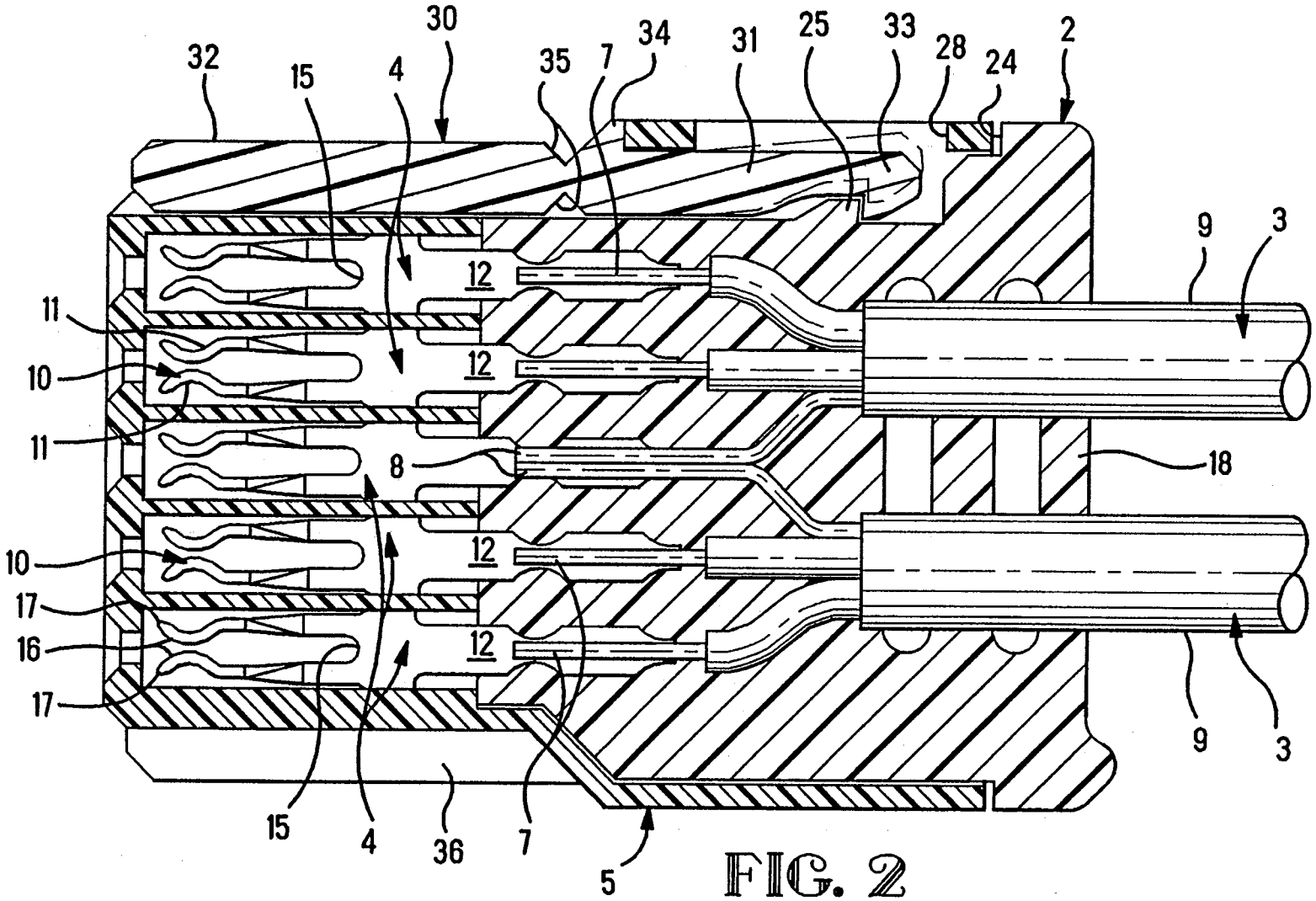
FIG. 2 is a view in section of the cable connector as shown in FIG. 1 with the parts assembled together.
Figure 3:
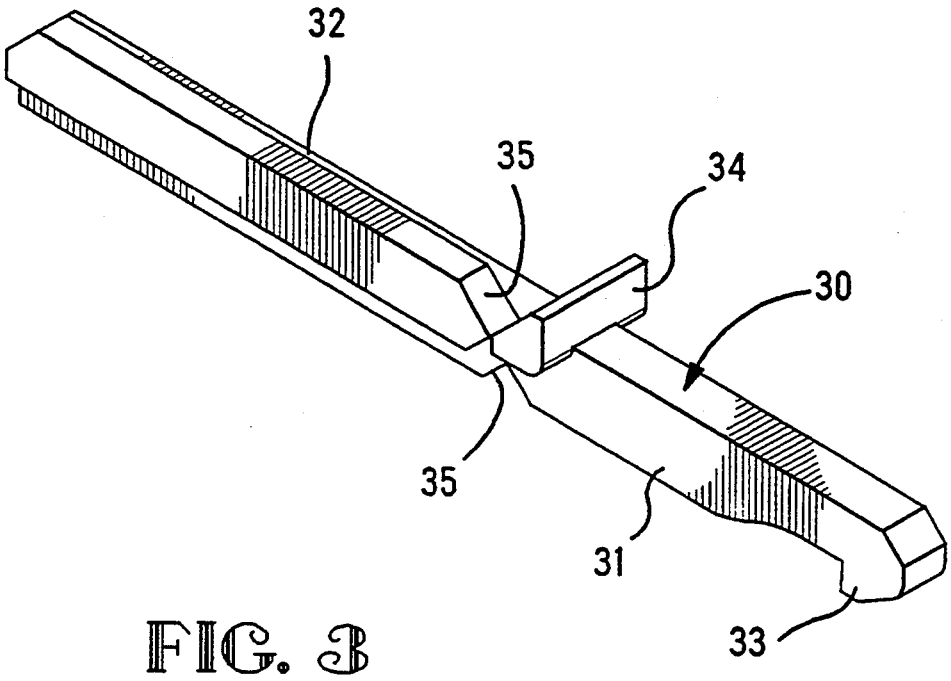
FIG. 3 is an isometric view of a latch and key.

With reference to FIGS. 1 and 2, each contact 4 is of unitary, stamped and formed construction, and includes a front electrical receptacle 10 formed between two opposed, spring resilient spring fingers 11, and a rear, wire connecting portion 12 connected to a signal wire 7 or a ground wire 7, in the manner as desired previously. Mutually coplanar portions 14 of the spring fingers 11 extend forward from a planar web 15 joining the spring fingers 11. Forward of the coplanar portions 14 of the spring fingers 11, the lengths of the spring fingers 11 are twisted ninety degrees from the plane of the web 15 to provide curved contact surfaces 16 opposing each other. In this manner, the contacts 4 remain slender, and are constructed especially for placement closely on pitch spacings side to side. Each contact 4 is made from relatively thin metal strip, gaining stiffness and spring strength in the spring fingers 11 from the twisted configuration. Front tips 17 of the spring fingers 11 curve outwardly from each other to provide a flared entry for receipt of a slender, conductive pin, not shown, between the contact surfaces 16. The spring fingers 11 are for the well know use to grip a conductive pin on opposite sides to provide an electrical connection between the contact 4 and the pin. Examples of such a pin are disclosed in U.S. Pat. No. 4,984,992.

With reference to FIG. 1, following connection of the contacts 4 to the respective, signal wires 7 and the ground wires 8, the housing block 2 is applied over the wire connecting portions 12 of the contacts 4 where they are connected to the signal wires 7 and ground wires 8. A strain relief portion 18 of the housing block 2 is applied to encircle exteriors of the cables 3 to provide a strain relief. The housing block 2 is an insulative plastics material that is applied by being injection molded, for example, to cover the wire connecting portions 12 and encircle the cables 3.

With reference to FIGS. 1 and 2, a front of the housing block 2 and a rear of the housing 5 telescope together, with the housing 5 registering against a stop surface 24 on the housing block 2. On one side of the housing block 2, a projection 25 extends laterally. On one side of the housing 5, a recessed keyway 26 is in line with a passage 27 extending through a rear of the housing 5. A window 28 in the housing 5 communicates with the passage 27. The keyway 26 and passage 27 are aligned with the projection 25. An external knob receiving recess 29 in the housing 5 is at a front of the passage 27.

Figure 4:
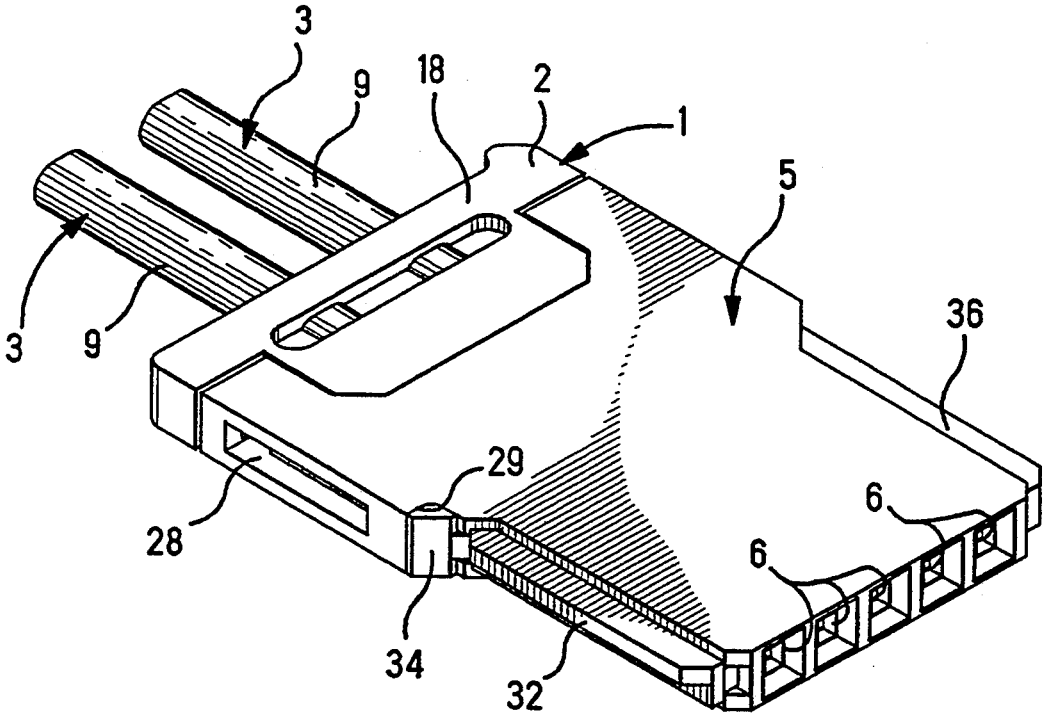
FIG. 4 is an isometric view of the cable connector as shown in FIG. 1 with the parts assembled together.

A break away key and latch assembly 30 will now be described. A hook shaped latch 31 is constructed for sliding fit along the keyway 26 and the passage 27. The latch 31 is unitary and in line with a tandem, elongated key 32 constructed for sliding fit along the keyway 26. A hook 33 on the latch 31, in alignment with the window 28, will hook onto the projection 25 on the housing block 2, attaching together the housing 5 and the housing block 2, and limiting movement of the latch 31 in a direction that would allow removal of the latch 31 from the passage 27. The latch 31 is unitary with a knob 34 that joins and bridges across the latch 31. The hook 33 registers in the recess 29, FIG. 4, to limit movement of the latch 31 in a reverse direction. The key 32 is weakened by notches 35, or some other form of score lines, at the junction of the key 32 with the latch 31. This allows breaking away and separation of the key 32 from the latch 31, leaving the latch 31 in place, and allowing removal of the key 32 from the keyway 26, if desired.

To remove the latch 31, a tool, such as a screwdriver, not shown, can enter the window 28, and pry on the hook 33 to deflect the hook 33 away from the projection 25. A deflected position of the hook 33 is shown in phantom outline in FIG. 2. Force can be applied to the knob 34, as it projects from the housing 5, to slide the latch 31 removably along the passage 27 in a direction that would allow removal of the latch 31 from the passage 27.

Figure 5:
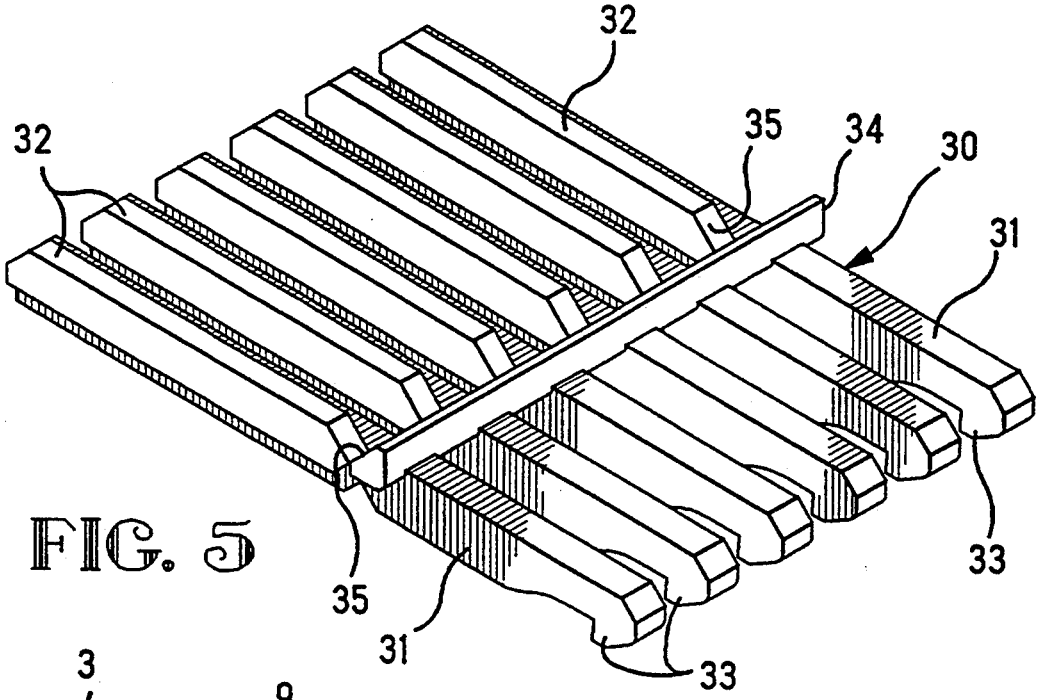
FIG. 5 is an isometric view of multiple keys connected together; and with parts shown cut away and removed.
Figure 6:
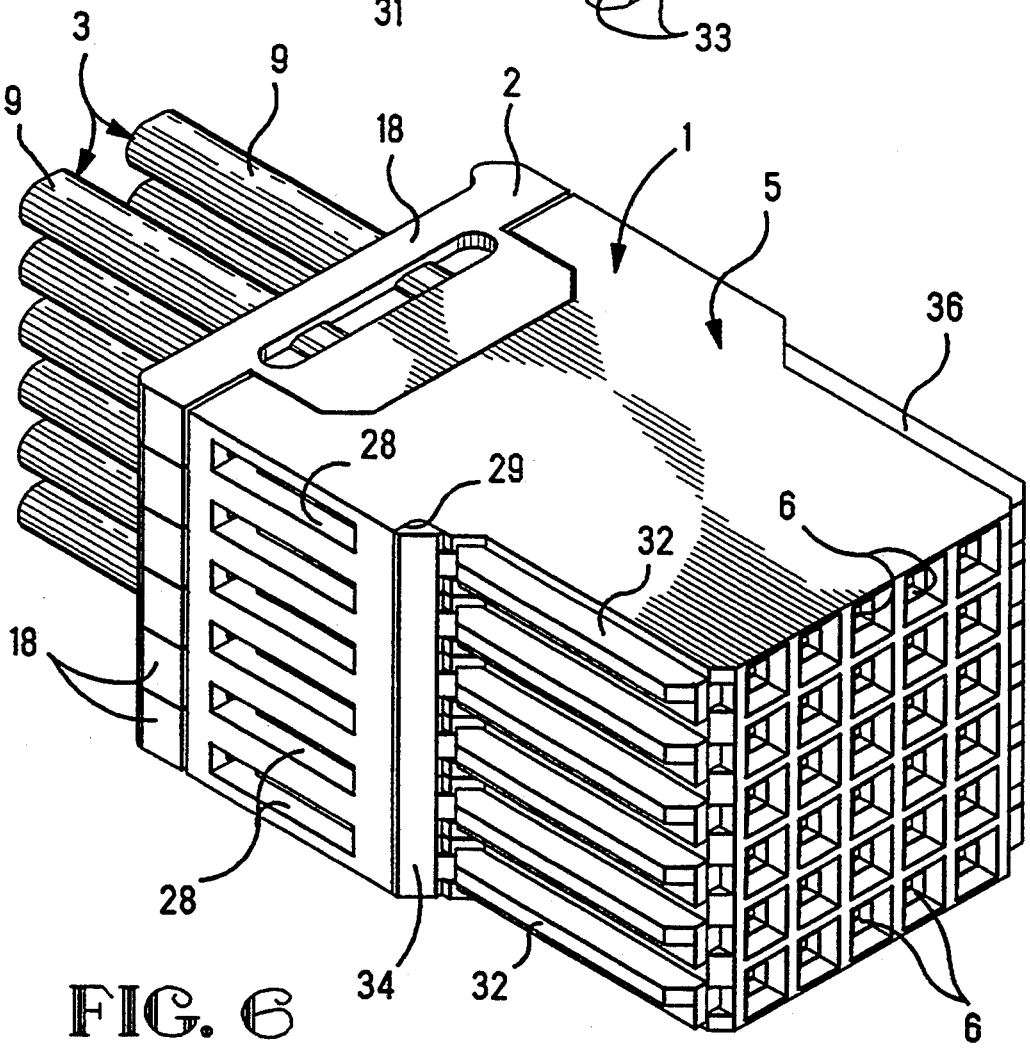
FIG. 6 is a an isometric view of a cable connector assembled with multiple keys.

FIG. 5 illustrates a break away key and latch assembly 30 for multiple connectors 1 located side to side in a stack of connectors 1, FIG. 6. The multiple connectors can be of a single composite construction, by molding, for example. Each of the connectors 1 in the stack is constructed similarly as the connector 1 shown in FIG. 1, 2 and 4, with a keyway 26 and passage 27 in line, which are aligned with a projection 25. The break away key and latch assembly 30 shown in FIG. 5 is of unitary polymer construction, with a knob 34 joining and bridging across the latches 31. The knob 34 will register in each of the knob receiving recesses 29 of the multiple connectors 1 in the stack. The keys 32 in the assembly 1 disclosed in FIG. 5 are constructed with weakening notches 35 that enable removal of each of the keys 32 individually. Selected, individual keys 32 can be removed from the assembly 30 disclosed in FIG. 6 to provide various keying combinations for the connectors 1 in the stack. Another side of each housing 5 is provided with a polarization rib 36 for positioning the corresponding connector 1 along a header, not shown. Further details of a header are disclosed in U.S. patent application Ser. No. 08/035,132 filed Mar. 19, 1993.

Other embodiments and modifications of the invention, and accompanying advantages, are intended to be included in the spirit and scope of the claims.

We claim:

1. An electrical connector comprising: an insulating housing block, electrical contacts in the housing block, an insulating housing, a break away key and latch assembly comprising, an in line latch and key joined together, the latch being constructed to connect to the housing, the key being constructed to be removed from the latch, the latch being constructed to connect to the housing without the key being joined to the latch, a hook on the latch removably connected to the housing block, and a keyway in the housing through which the latch passes to engage and connect with the housing block.

2. An electrical connector as recited in claim 1, and further comprising: a knob projecting from the latch and constructed for registration on an exterior of the housing.

3. An electrical connector as recited in claim 1, and further comprising: a window through the housing aligned with hook on the latch.

4. An electrical connector as recited in claim 1, and further comprising: a passage in the housing, the passage being aligned with the keyway receiving the latch.

5. An electrical connector as recited in claim 4, and further comprising: a window through the housing communicating with the passage, the window being aligned with the hook.

6. An electrical connector comprising: an insulating housing block, electrical contacts in the housing block, a break away key and latch assembly comprising, an in line latch and key joined together, a hook on the latch removably connected to the housing block and a keyway in the housing through which the latch passes to engage and connect with the housing block, multiple, additional keys in parallel with one another and joined to multiple, additional latches, a knob bridging across the additional latches, multiple, additional housing blocks to which the additional latches are connected, and multiple, additional housings having additional keyways through which the additional latches pass to engage and connect with the additional housing blocks.

7. An electrical connector as recited in claim 6, and further comprising: said knob projecting from the additional latches and being constructed for registration on an exterior of the additional housings.

8. An electrical connector as recited in claim 7, and further comprising: the additional keys being removably joined with the additional latches.

9. An electrical connector as recited in claim 8, and further comprising: windows through the additional housings aligned with hooks on the additional latches.

10. An electrical connector as recited in claim 8, and further comprising: passages in the additional housings, the passages being aligned with the additional keyways receiving the additional latches.

11. An electrical connector as recited in claim 10, and further comprising: additional windows through the additional housings communicating with the additional passages, the additional windows being aligned with the hooks on the additional latches.

* * * * *